US005111969A

United States Patent [19]

Knepler, John T.

[11] Patent Number: 5,111,969

[45] Date of Patent: May 12, 1992

[54] HOT WATER DISPENSER WITH ELECTRONIC CONTROL

[75] Inventor: Knepler, John T., Chatham, Ill.

[73] Assignee: Bunn-O-Matic Corporation, Springfield, Ill.

[21] Appl. No.: 589,080

[22] Filed: Sep. 27, 1990

[51] Int. Cl.[5] ..... B67D 5/08; G04C 23/00

[52] U.S. Cl. ..... 222/54; 99/280; 222/641; 222/644; 222/146.5

[58] Field of Search ..... 222/54, 639-641, 222/644, 146.5; 99/280, 285, 323.3

[56] References Cited

U.S. PATENT DOCUMENTS

| | | | |
|---|---|---|---|
| 3,823,846 | 7/1974 | Probst | 222/641 |
| 3,976,222 | 8/1976 | Spagnolo | 222/641 |
| 4,004,715 | 1/1977 | Williams et al. | 222/640 X |
| 4,055,279 | 10/1977 | Lapera et al. | 222/54 |
| 4,202,387 | 5/1980 | Upton | 222/641 X |
| 4,331,262 | 5/1982 | Snyder et al. | 222/644 X |
| 4,450,987 | 5/1984 | Boettcher et al. | 222/641 |
| 4,782,744 | 11/1988 | Bunn | 99/307 |
| 4,917,005 | 4/1990 | Knepler | 99/280 |

FOREIGN PATENT DOCUMENTS 2034922 6/1980 United Kingdom ..... 222/644

*Primary Examiner*—Kevin P. Shaver

*Attorney, Agent, or Firm*—Trexler, Bushnell, Giangiorgi & Blackstone, Ltd.

[57] ABSTRACT

A control apparatus is provided for a dispensing mechanism having an electrically operated dispensing control member and a sensor for sensing a first predetermined condition and producing a condition control signal for permitting or preventing operation of the dispensing control member in accordance with the predetermined condition. The control apparatus comprises a dispensing duration timer responsive to the condition control signal for permitting operation of the dispensing control member, for producing a dispensing control signal for a selectable amount of time for controlling the time duration of the operation of the dispensing control member and a delay timer responsive to the dispensing duration timer control for a selectable amount of time following dispensing duration of the timer control signal for preventing a further operation of the dispensing duration timer for a selectable amount of time following each dispensing operation.

9 Claims, 4 Drawing Sheets

HOT WATER DISPENSER WITH ELECTRONIC CONTROL

BACKGROUND OF THE INVENTION

This invention is directed to improvements in dispensing apparatus, and in particular to a novel and improved electronic control system for use with a hot water dispensing apparatus.

It is frequently desirable in restaurants, offices and the like to have a ready source of hot water for various beverage brewing and/or cooking purposes, as well as for cleaning purposes. To supply hot water for these and other uses, hot water dispensers have come into increasing use. Typically, such hot water dispensers employ a hot water reservoir in which hot water is heated by an electric resistance heater element. The application of electric current to the heating element is typically controlled by various means responsive to a temperature sensing element in the reservoir to achieve a predetermined dispensing temperature.

While the improvement of the invention may be useful in a variety of applications, the invention will be particularly described in connection with the control of dispensing of hot water from a hot water dispenser of the type primarily intended for use in brewing beverages such as tea, hot chocolate, and the like. Such a hot water dispenser generally includes a thermostat to achieve accurate temperature control of the water for dispensing at a desired temperature. Generally speaking, this thermostat energizes a "ready" indicator lamp when the water has been heated to the desired temperature, or to some predetermined temperature near the desired temperature. Often, such dispensers have utilized a manually operated faucet or spigot to dispense the water. However, the present invention utilizes an electrically operated solenoid-controlled valve to electrically control the dispensing of hot water. Operation of the valve may also be controlled by the thermostat to prevent dispensing when the water is not at the desired temperature.

Preferably the hot water dispenser also has a flow regulator in an input water line for replacing water, as dispensed, at a controlled rate. Accordingly, a presettable timer may be utilized to control the solenoid-operated dispensing valve and this will result in a consistent and controlled volume of dispensed water. Such control is particularly useful when the water is used repetitively in the same recipe, or to repeatedly brew a preselected, constant quantity of beverage. This also permits the user to perform other tasks while the water is being dispensed unattended.

When a batch of water has been dispensed as described, it is automatically replaced with the incoming, unheated water through the above-mentioned flow regulator in the input water line. However, in order to to assure that the dispensed water will always be at or near the desired temperature, the present invention employs further means to prevent the user from dispensing a further batch or quantity of hot water when the brewing apparatus does not contain enough hot water to complete the batch before the temperature drops to an unacceptable level. Thus the dispensing of further water is prevented until the same predetermined amount or batch is again heated to the desired temperature. Only at this point may the solenoid-operated dispensing valve again be activated to dispense a further batch or quantity of hot water.

This feature also prevents dispensing water which is not at the desired temperature following a power failure, or following manual dispensing. The brewing apparatus may include a separate manual dispensing switch for manually operating the solenoid-operated dispensing valve when amounts other than preselected timed dispensing amount or batch size are desired.

It should be recognized in this regard that the use of a thermostat to enable or disable valve operation will not necessarily achieve the foregoing end. For example, before the reservoir has completely refilled with water following a dispensing operation, the thermostat may indeed indicate heating of the partial batch of water to the desired temperature. However, if an attempt were made to dispense a further full batch at this point, at least a portion of the batch would be provided from incoming, unheated water and hence the temperature of the batch would be well below the desired temperature. Accordingly, it is an aim of this invention to assure that at least one complete batch or quantity of water is heated to the desired temperature before initiating dispensing thereof.

OBJECTS AND SUMMARY OF THE INVENTION

Accordingly, it is a general object of the invention to provide a novel and improved control system for a hot water dispensing apparatus.

It is a more specific object of the present invention to provide a novel and improved control system which prevents the dispensing of a quantity of hot water when the apparatus does not contain a sufficient supply of hot water to dispense a given quantity at the desired temperature.

Briefly, and in accordance with the foregoing objects, the present invention provides control apparatus for a dispensing mechanism having an electrically operated dispensing control member and sensing means for sensing a first predetermined condition and producing a condition control signal for permitting or preventing operation of said dispensing control member in accordance with said first predetermined condition; said control apparatus comprising dispensing duration timer means responsive to said condition control signal for permitting operation of said dispensing control member for producing a dispensing control signal for a selectable amount of time for controlling the time duration of operation of said dispensing control member; and delay timer means responsive to said dispensing duration timer control signal for producing a delay timer control signal for a selectable amount of time following said dispensing duration timer control signal for preventing a further operation of said dispensing duration timer means for a selectable amount of time following each dispensing operation.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figure 1:
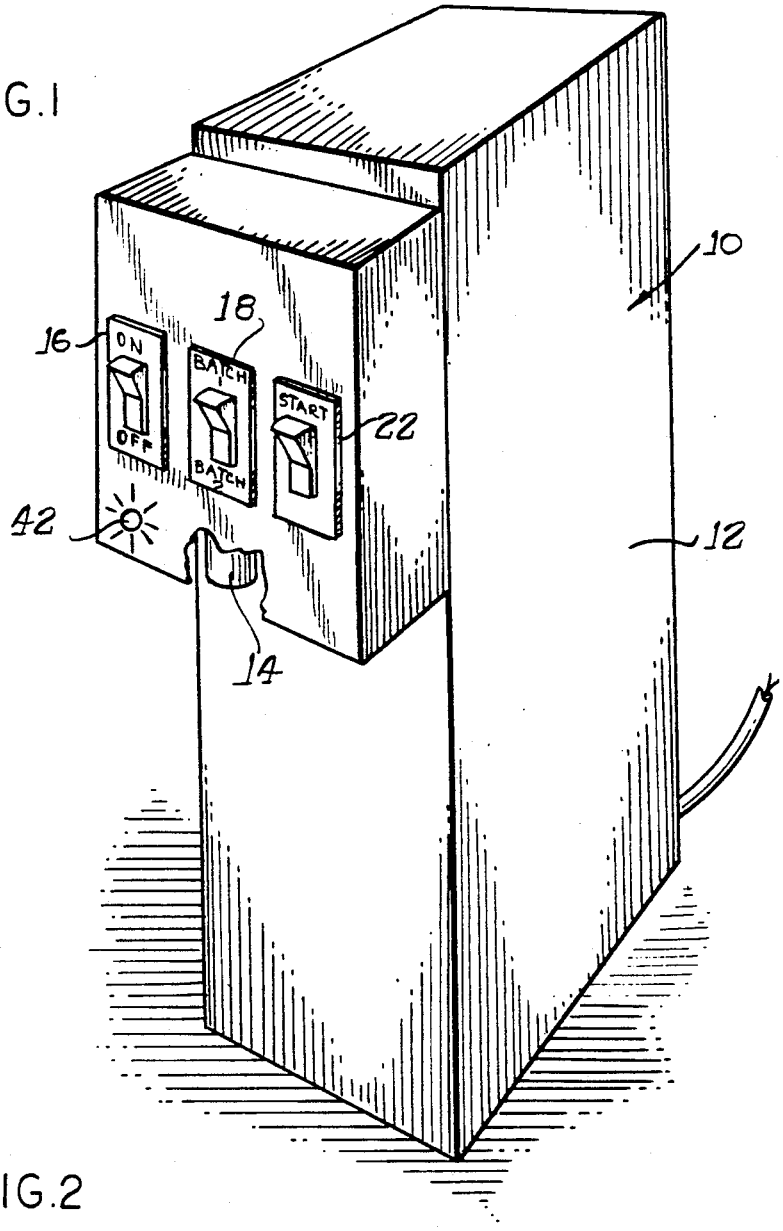
FIG. 1 is a perspective view, partially broken away, showing an exemplary hot water dispenser embodying the present invention.
Figure 3:
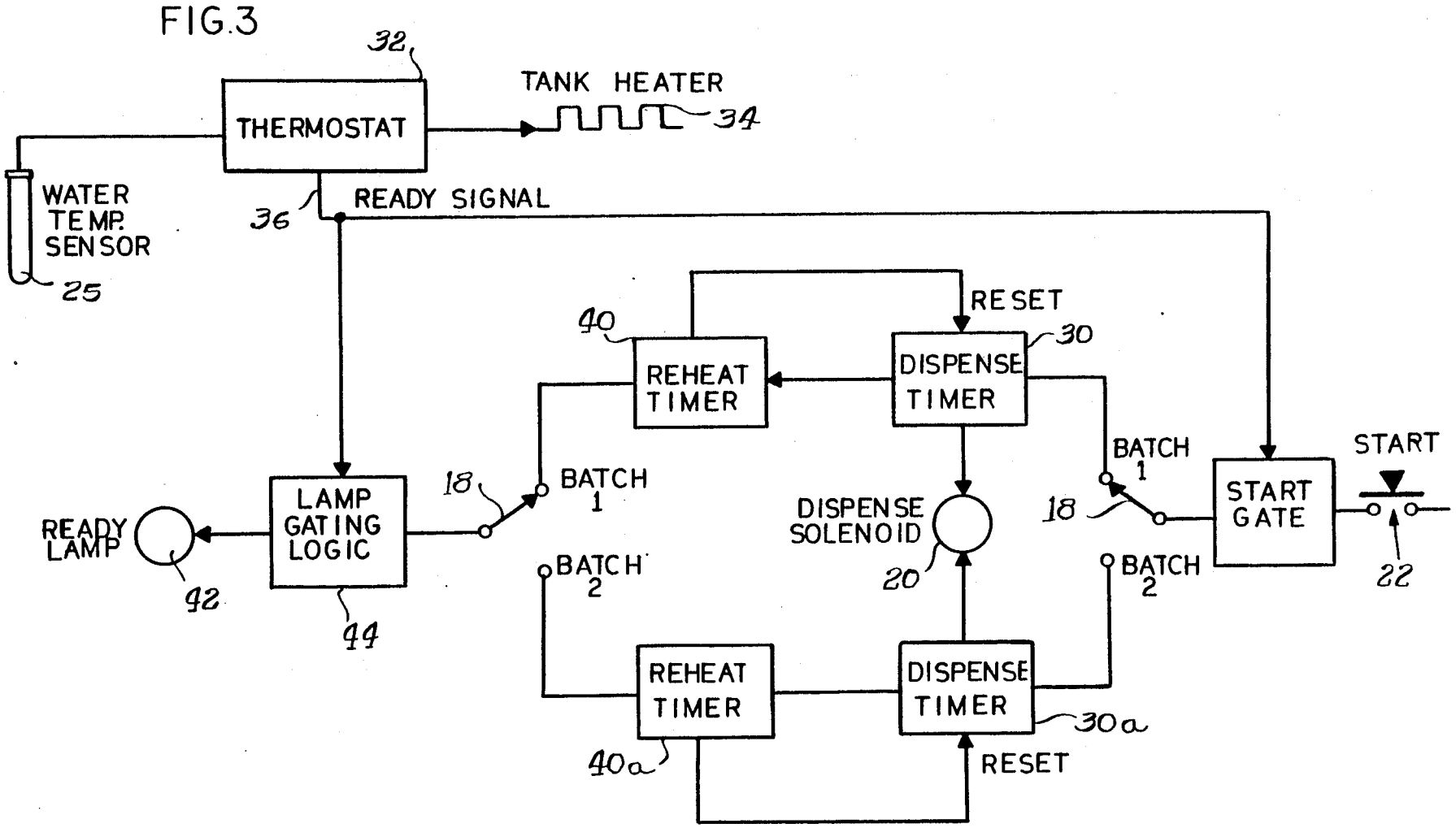
FIG. 3 is a functional block diagram of the control apparatus of the invention.

Referring to the drawings, and initially to FIGS. 1 and 3, a control system or apparatus, illustrated in block diagrammatic form in FIG. 3 is provided for a dispensing mechanism such as a hot water dispenser 10 illustrated in FIG. 1. The control system of the invention may be utilized with dispensing apparatus of other types without departing from the invention, the foregoing hot water dispenser being by way of specific example for purposes of description and illustration.

The hot water dispenser or dispensing mechanism 10 includes a hot water reservoir 12 for holding a quantity of hot water and suitable means such as a constant flow inlet valve (not shown) are provided for refilling reservoir 12 as water is dispensed therefrom. An electrically operated solenoid controlled dispensing valve indicated by its associated solenoid 20 in FIG. 3, is responsive to predetermined electrical control signals for opening and closing the valve to dispense hot water. In this regard, a hot water dispensing outlet 14 is illustrated in FIG. 1 at a front upper portion of the dispenser 10. Dispenser 10 additionally provides relatively simple front panel controls including a power on/off switch 16, a batch selection switch 18, to be explained later herein, and a start switch 22 to initiate a dispensing operation under control of the control system or apparatus of the invention, to be described hereinbelow.

Referring now more particularly to FIG. 3, a condition control sensor which, in the illustrated embodiment, comprises a water temperature sensor 25 controls a thermostat device 32 which in turn produces temperature control signals. These temperature control signals are used for controlling a reservoir or tank heater 34 and for producing a control or "ready" signal as indicated at reference numeral 36 for respectively permitting or preventing operation of the dispensing control member or dispense solenoid 20. This first control signal is fed to dispensing duration timer means or dispense timer 30 which is responsive to the temperature control signal which permits solenoid operation for producing a further dispensing control signal for a predetermined selectable amount of time for controlling the time duration of operation of the solenoid or other dispensing control member 20. Hence, in the hot water dispenser of the illustrated embodiment, the dispense solenoid 20 is permitted to open the dispensing valve for a preselected and controllable amount of time in response to the dispensing duration timer means 30.

Figure 4A:
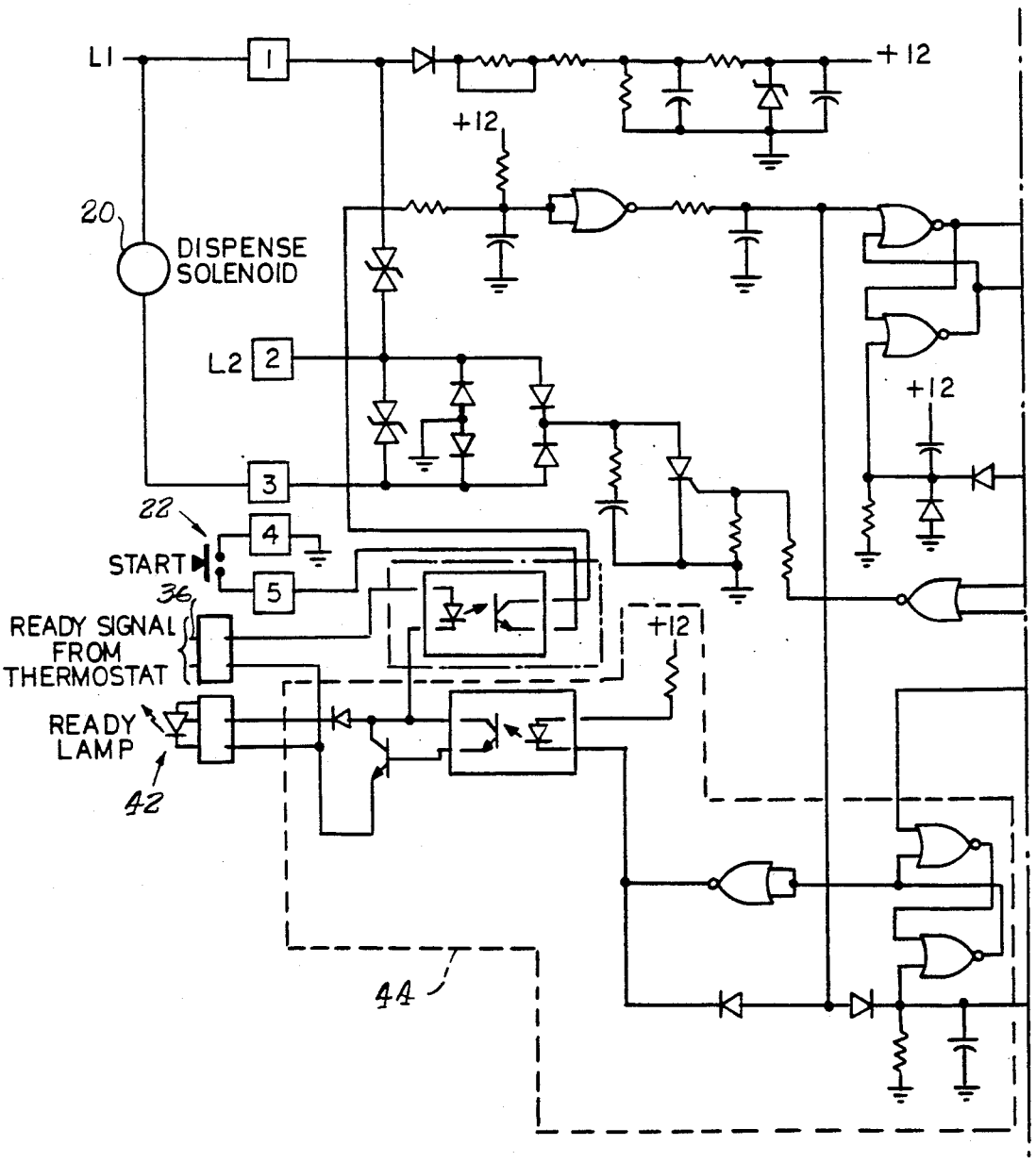
FIGS. 4A and 4B taken together form a schematic circuit diagram of a preferred embodiment of the control system of the invention.
Figure 4B:
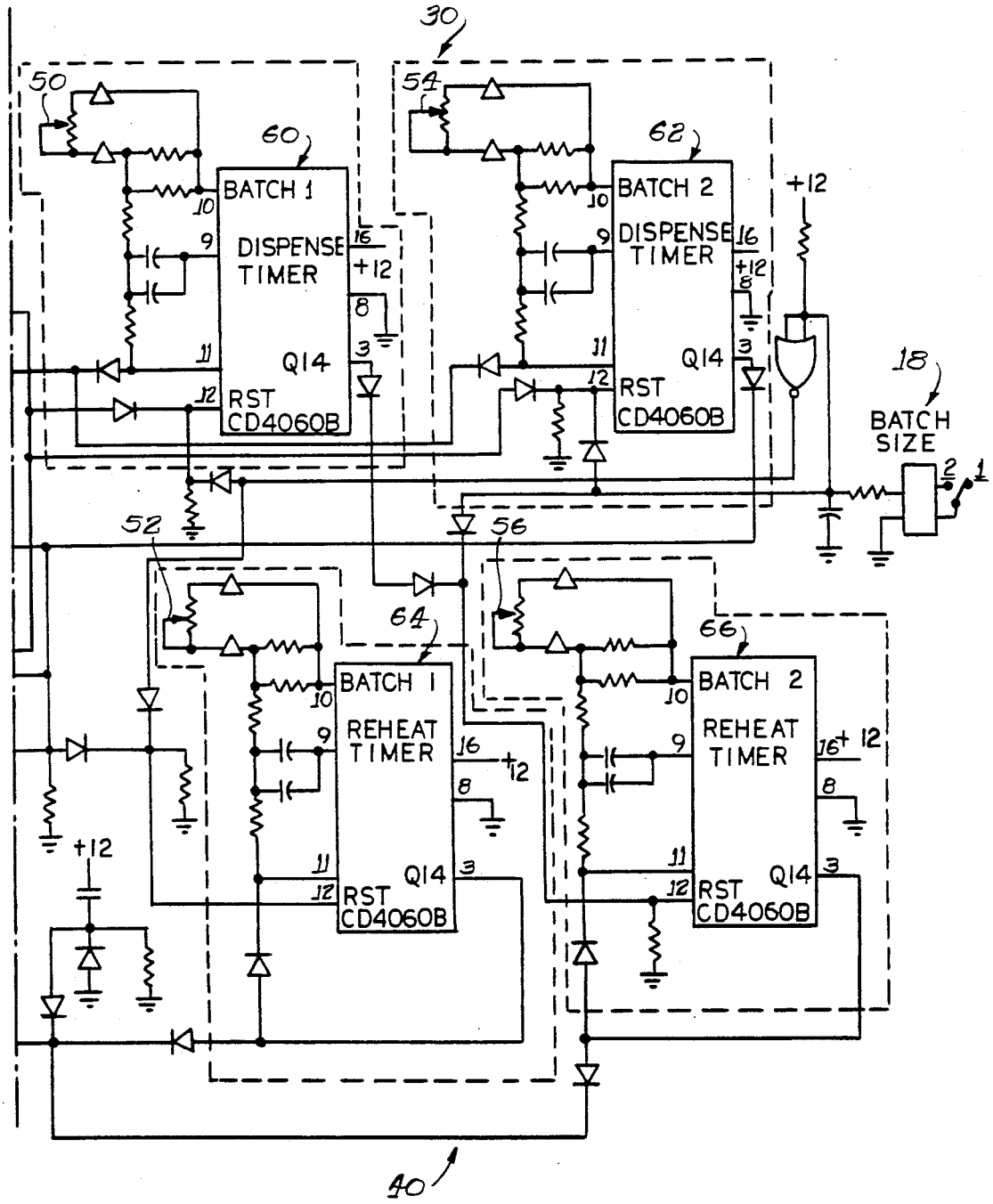

In the embodiment illustrated in FIGS. 4A and 4B, the dispense duration timer means includes a pair of separately and independently controllable and presettable timers 60 and 62 which permits either of two selectable amounts of time of opening of the solenoid valve. This in turn allows at least tw different size batches or quantities of hot water to be dispensed as selected by a batch selector switch 18.

In accordance with a further feature of the invention, a further delay timer means 40 is provided which is responsive to the dispensing duration time signal produced by the dispensing duration timer means 30 for producing a delay timer control signal for a second selectable amount of time following the termination of the dispensing duration timer control signal. This further delay timer control signal prevents further operation of or resetting of the dispensing duration timer means 30 for a selectable amount of time following each dispensing operation. In the illustrated embodiment (FIGS. 4A and 4B), the delay timer means includes two similar reheat timers 64 and 66, respectively, associated with the dispense timers 60 and 62, for selecting an appropriate delay time following dispensing before the associated dispense timer may again be reset and enabled for a subsequent dispensing operation. It will be appreciated that the purpose of the delay or reheat timer is to allow sufficient time for a further quantity of unheated water entering the reservoir 12 and replacing that quantity just dispensed to come up to the desired dispensing temperature, prior to permitting a further dispensing of hot water. It will be appreciated further that the time duration provided by each dispense timer and its associated reheat timer will vary in direct relation to the desired batch size or preselected quantity of water to be dispensed in each dispensing operation.

The hot water dispenser also includes a ready lamp 42 for indicating to an operator that the dispensing may commence; i.e., that a sufficient quantity of desired temperature hot water is present in the reservoir to dispense a complete batch of desired size. The ready lamp is in turn energized by lamp gating logic 44 which requires both a ready signal from the thermostat 32 as previously discussed and the timing out of the delay timer means 40 before energizing the ready lamp. The appropriate associated ones of dispense timers 60 or 62 and of reheat timers 64 or 66 for a given batch size are selected by operation of the batch selection switch 18.

Figure 2:
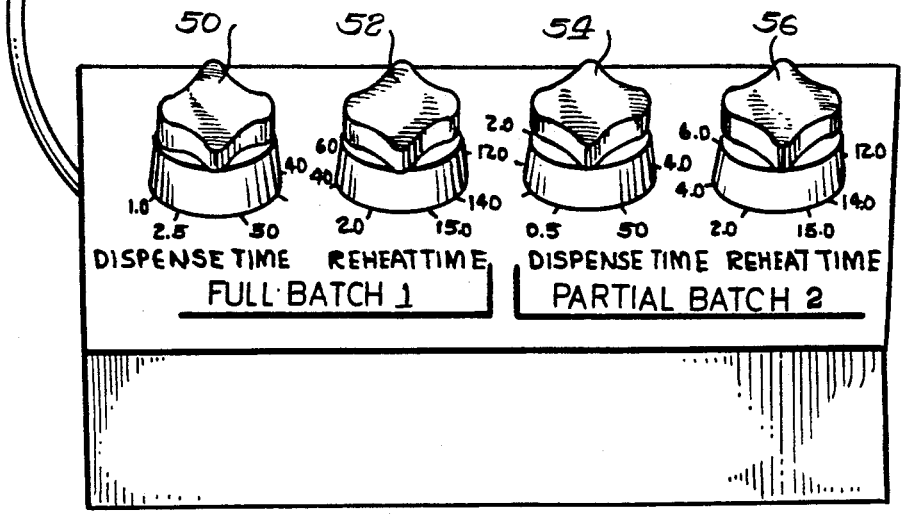
FIG. 2 is a perspective view of a control panel for the hot water dispenser of FIG. 1 and embodying features of the invention.

Referring to FIG. 2, each of the dispense timers 60, 62 and reheat timers 64, 66 is further provided with means for preselecting the length of the time duration or time delay provided thereby. Each of these timers is thus independently adjustable for independently selecting and controlling the selectable amount of time during which their respective control signals are produced. These means are shown somewhat diagrammatically in FIG. 2 in connection with corresponding control dials 50, 52 and 54, 56, and in schematic circuit form, as variable resistors or potentiometers in FIG. 4B.

In FIGS. 4A and 4B, like parts and components of the block diagram of FIG. 3 are designated by like reference numerals.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. Control apparatus for a dispensing mechanism having an electrically operated dispensing control member and sensing means for sensing a first predetermined condition and producing condition control signals for respectively permitting or preventing operation of said dispensing control member in accordance with said first predetermined condition; said control apparatus comprising:

dispensing duration timer means responsive to said condition control signal for permitting operation of said dispensing control member, for producing a dispensing control signal for a selectable amount of time for controlling the time duration of operation of said dispensing control member;

and delay timer means responsive to said dispensing duration timer control signal for producing a delay timer control signal for a selectable amount of time following said dispensing duration time control signal for preventing a further operation of said dispensing duration timer means for a selectable amount of time following each dispensing operation.

2. Apparatus according to claim 1 wherein said dispensing duration timer means and said delay timer means comprise independently adjustable timers for independently selecting and controlling the selectable amount of time during which each of said dispensing duration timer control signal and said delay timer control signal are produced.

3. Apparatus according to claim 1 wherein each of said dispensing duration timer means and said delay timer means includes a plurality of independent timers for preselecting a plurality of different said selectable amounts of time independently, and further including selector means for selecting any one of said timers comprising said dispensing timer means and any one of said timers comprising said delay timer means for control of the operation of said dispensing control member.

4. Control apparatus for a hot water dispensing mechanism having a hot water reservoir and an electrically operated dispensing control valve and temperature sensing means for sensing the temperature of water in said reservoir and producing temperature control signals for respectively permitting or preventing opening of said dispensing control valve in accordance with said temperature, said control apparatus comprising:

dispensing duration timer means responsive to said temperature control signal for permitting operation of said dispensing control valve, for producing a dispensing control signal for a selectable amount of time for controlling the time duration of opening of said dispensing control valve;

and delay timer means responsive to said dispensing duration timer control signal for producing a delay timer control signal for a selectable amount of time following said dispensing duration timer control signal for preventing a further operation of said dispensing duration timer means for a selectable amount of time following each dispensing operation.

5. Apparatus according to claim 4 wherein said dispensing duration timer means and said delay timer means comprise independently adjustable timer for independently selecting and controlling the selectable amount of time during which each of said dispensing duration timer control signal and said delay timer control signal are produced.

6. Apparatus according to claim 4 wherein each of said dispensing duration timer means and said delay timer means includes a plurality of independent timers for preselecting a plurality of different said selectable amounts of time independently, and further including selector means for selecting any one of said timers comprising said dispensing timer means and any one of said timers comprising said delay timer means for control of the operation of said dispensing control member.

7. Control apparatus for a dispensing mechanism having an electrically operated dispensing control member and a sensor for sensing a first predetermined condition and producing condition control signals for respectively permitting or preventing operation of said dispensing control member in accordance with said first predetermined condition; said control apparatus comprising:

a dispensing duration timer responsive to said condition control signal for permitting operation of said dispensing control member, for producing a dispensing control signal for a selectable amount of time for controlling the time duration of operation of said dispensing control member;

and a delay timer responsive to said dispensing duration timer control signal for producing a delay timer control signal for a selectable amount of time following said dispensing duration time control signal for preventing a further operation of said dispensing duration timer for a selectable amount of time following each dispensing operation.

8. Apparatus according to claim 7 wherein said dispensing duration timer and said delay timer comprise independently adjustable timers for independently selecting and controlling the selectable amount of time during which each of said dispensing duration timer control signal and said delay timer control signal are produced.

9. Apparatus according to claim 7 wherein each of said dispensing duration timer and said delay timer includes a plurality of independent timers for preselecting a plurality of different said selectable amounts of time independently, and further including a selector for selecting any one of said dispensing timers and any one of said delay timers for control of the operation of said dispensing control member.

* * * * *